US006082339A

United States Patent [19]

Wey

[11] Patent Number: 6,082,339

[45] Date of Patent: Jul. 4, 2000

[54] COMBUSTION ENHANCEMENT DEVICE

[76] Inventor: Albert C. Wey, 233 E. 57th St., Westmont, Ill. 60559

[21] Appl. No.: 09/162,413

[22] Filed: Sep. 28, 1998

[51] Int. Cl.[7] ..... F02M 33/00

[52] U.S. Cl. ..... 123/538

[58] Field of Search ..... 123/536, 537, 123/538, 539

[56] References Cited

U.S. PATENT DOCUMENTS

| | | | |
|---|---|---|---|
| 4,886,972 | 12/1989 | Nokai . | |
| 5,044,346 | 9/1991 | Tada et al. | 123/538 |
| 5,460,144 | 10/1995 | Park et al. | 123/538 |
| 5,632,254 | 5/1997 | Kim . | |
| 5,873,353 | 2/1999 | Mekita | 123/538 |

FOREIGN PATENT DOCUMENTS

| | | |
|---|---|---|
| 0 669 456 | 8/1995 | European Pat. Off. . |

*Primary Examiner*—Marguerite McMahon
*Attorney, Agent, or Firm*—Piper Marbury Rudnick & Wolfe

[57] ABSTRACT

A device comprising a housing having a far infrared ray emitting body placed therein that provides for enhanced combustion of liquid fuels. The device can be inserted to the fuel line before the point where fuel flows into a carburetor or fuel injection system. The result is improved fuel burning efficiency, increased engine power, and reduced harmful emissions.

5 Claims, 3 Drawing Sheets

COMBUSTION ENHANCEMENT DEVICE

BACKGROUND

1. Field of Invention

This invention relates to a device with a far infrared ray emitting body in a metal housing for enhancing the combustion of liquid fuel.

2. Description of Prior Art

Several types of devices have been developed and patented for increasing engine power and reducing exhaust pollution as a result of improved fuel efficiency. For example, one type of devices (U.S. Pat. No. 5,092,303) employed techniques by catalytic cracking of long-chain liquid hydrocarbons, the other (U.S. Pat. No. 5,271,369) by inducing a magnetic field in the fuel to break up the fuel into small particles. However, these devices do not work satisfactorily. A far infrared ray generating composition was later added to the device employing magnetic field (U.S. Pat. No. 5,632,254) as an accessory for improvement. Such a device makes implementation complicated and impractical.

OBJECTS AND ADVANTAGES

Accordingly, one object of this invention is to provide a device that will enhance combustion efficiency. As a result, this device will increase the power or acceleration of an internal combustion engine and, at the same time, reduce harmful emissions.

Another object of the present invention is to provide an effective and easy-to-install combustion enhancement device.

These objectives are achieved by a device comprising:

a metal housing which defines an interior chamber; and a far infrared ray emitting body placed within said interior chamber.

The device can be installed in the fuel line before the point where fuel flows into a carburetor or fuel injection system. The device is economical of fuel and insertion of the device into the fuel line is easy, simple and safe.

DRAWING FIGURES

REFERENCE NUMBERALS IN DRAWINGS

| | |
|---|---|
| 11 | inlet/outlet nozzle |
| 12 | metal housing |
| 13 | far infrared ray emitting body |
| 14 | fixation pin |
| 15 | O-ring |
| 20 | fuel line |

SUMMARY

In accordance with the present invention a combustion enhancement device comprises a metal housing and a far infrared ray emitting body.

DETAILED DESCRIPTION OF THE INVENTION

Figure 1:
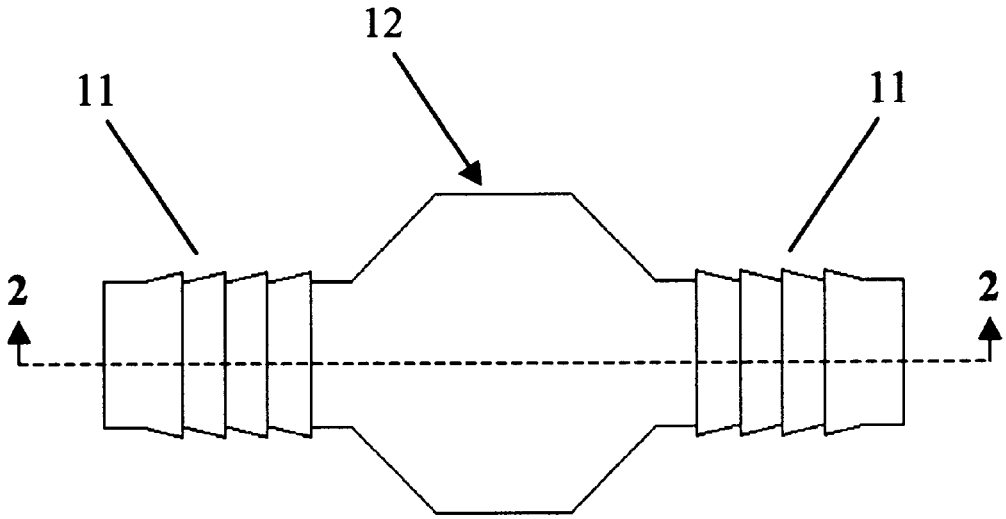
FIG. 1 shows a view of one embodiment of the present invention with a far infrared ray emitting body in a spherical form.

The device of the present invention comprises a metal housing that contains a tar infrared ray emitting body. The housing can be of any convenient shape and size. For ease of insertion to a fuel line, a tubular shape is preferred. The housing material can be metal such as steel, copper, or aluminum. Among them, aluminum housing is preferred because of its high reflectivity to far infrared rays and light weight. FIG. 1 shows the device having a tubular housing 12. The device is symmetrical along the vertical and horizontal central lines. One nozzle 11 can be used as an inlet, while another nozzle 11 works as an outlet. The fuel flows into and out of the device through the nozzles 11.

As an example of size, a tubular housing may have a typical length of 2 to 2.5 inches (5.1 to 6.4 mm approximately), with a typical outer diameter of about ¾ inch (19 mm). A thickness of 1/16 inch (1.6 mm) or less is typical for the housing wall.

Figure 2:
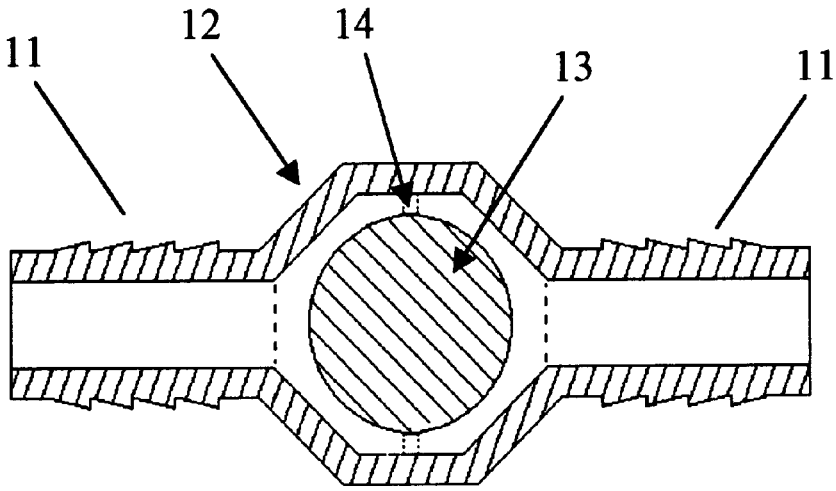
FIG. 2 shows a sectional view of FIG. 1 taken along the line 2—2

FIG. 2 shows a sectional view of the device. The housing 12 provides an interior compartment for holding the far infrared ray emitting body 13. The far infrared emitting body 13 is affixed to the housing wall 12 by several fixation pins 14.

The far infrared ray emitting body 13 is composed of oxides selected from the group consisting alumina, silica, alumina hydrate, silica hydrate, zirconia, lithium oxide, magnesium oxide, calcium oxide, titanium oxide, or a mixture of said oxides. Based on our research results, ceramics containing iron oxides were less effective than others (or might even have a reverse effect that would require further studies) and should be avoided.

The present inventor has undertaken extensive studies to select a far infrared ray emitting body possessing a stronger radiation capacity. As a result, the inventor found that the far infrared ray generating composition fabricated by the method described in U.S. Pat. No. 4,886,972 provided a larger radiation effect. As cited in the said Patent, the most effective far infrared radiation could be obtained when inorganic powders had a particle size below 500 angstrom, and preferably below 200 angstrom. Nevertheless, the inventor further found that only those far infrared emitting body comprising mixtures of compounds having an ultrafine inorganic powder with a particle size smaller than 100 angstroms would exhibit considerable radiation capacity that could effectively enhance fuel efficiency at a significant level.

Figure 3:
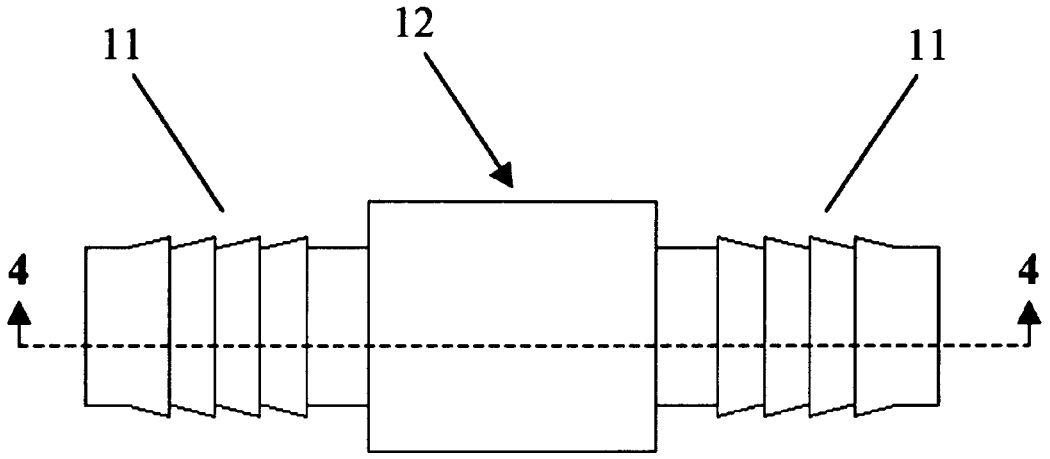
FIG. 3 shows a view of one embodiment of the present invention with a far infrared ray emitting body in a tubular form.
Figure 4:
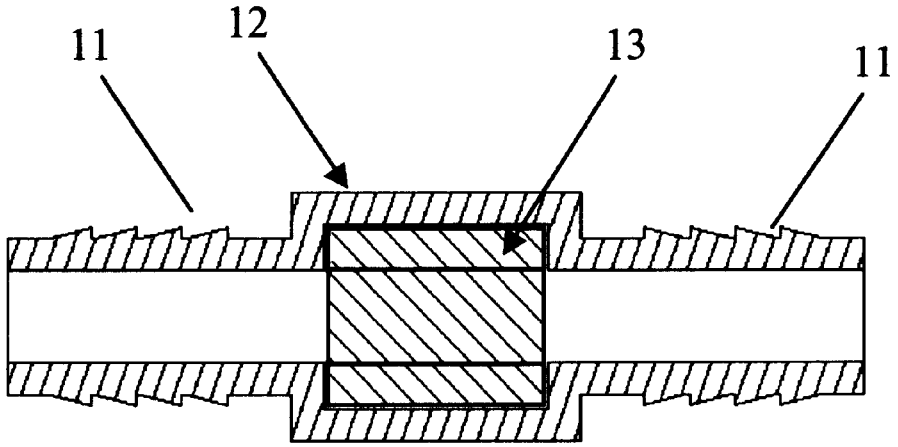
FIG. 4 shows a sectional view of FIG. 3 taken along the line 4—4.
Figure 5:
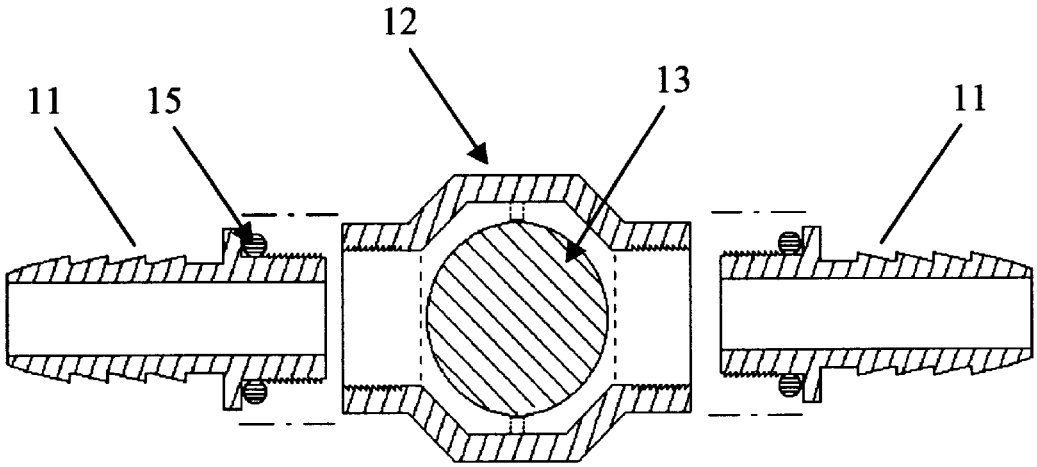
FIG. 5 shows a view of another embodiment of the present invention with an exchangeable inlet/outlet portion.

Another embodiment is shown in FIG. 3. The housing 12 have a different shape to accommodate the shape of far infrared ray emitting body 13. FIG. 3 shows an infrared ray emitting body 13 in a tubular shape, with a sectional view shown in FIG. 4. FIG. 5 illustrates an another embodiment that contains exchangeable nozzles 11. The nozzles 11 in FIG. 5 can be made in various outer diameters to fit in most of domestic and imported cars. An O-ring 15 is used to prevent fuel leakage.

Figure 6:
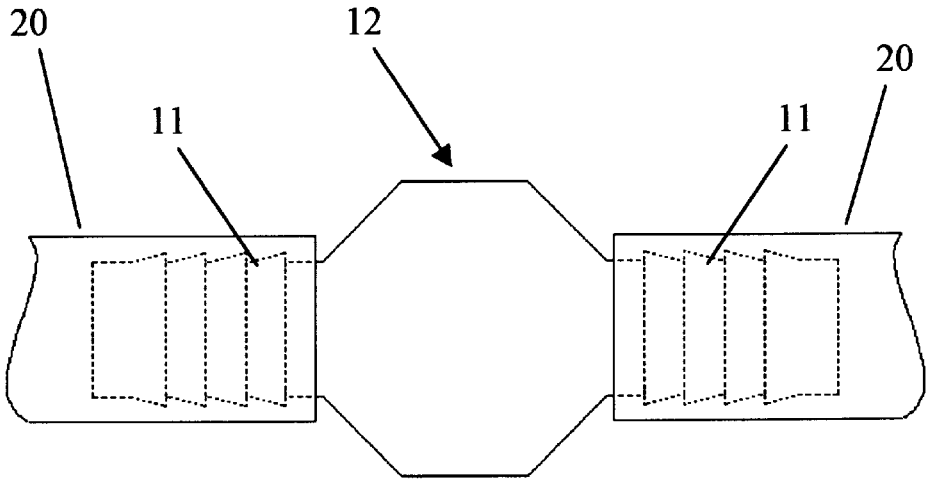
FIG. 6 shows a view of inserting the device of the present invention into a fuel line.

The device may be easily installed into the fuel line 20 by cutting the line and inserting the device in between as shown in FIG. 6. Clamps tying the lines to nozzles 11 of the device are needed to prevent the device from slipping off the fuel line.

EXAMPLE

A commercially available ceramic composition made in Japan was used to form the infrared ray emitting body in the invention, at a diameter of about 7/16 inch (11 mm). The core material of the composition was alumina hydrate, mixed with various oxides such as zirconia, lithium oxide, and titanium oxide. The composition had a desirable particle size of about 50 angstroms. The composition emitted infrared radiation in the wavelength region of about 3 to 14 microns. Four prototypes of the present invention were made and installed on various cars for testing. Preliminary results showed an average of 20% savings on gasoline consumption resulting from combustion efficiency enhancement. Reading with an exhaust analyzer, the amount of hydrocarbon and carbon monoxide had a significant drop after the device had been installed to the car.

CONCLUSION, RAMIFICATIONS, AND SCOPE

According to the present invention, a device comprising a metal housing, preferably aluminum, and a far infrared ray emitting body having a particle size smaller than 100 angstrom, preferably 50 angstrom or smaller, can effectively enhance combustion efficiency. As a result, this device will increase the power and acceleration of an internal combustion engine and reduce harmful emissions.

This device can be easily installed on nearly every car in the world with little effort.

This device of the present invention can also be applied to enhancing the tastes of a variety of drinks and foods in liquid form.

The invention has been described above. Obviously, numerous modifications and variations of the present invention are possible in light of the above teachings. Such variations are not to be regarded as a departure from the spirit and scope of the invention and all such modifications as would be obvious to one skilled in the art are intended to be included within the scope of the following claims.

I claim:

1. A device mounted for contact with fuel used for an internal combustion engine for activating the fuel and for thereby achieving efficient combustion of the fuel, said engine including a fuel line, said device consisting essentially of a housing and a far infrared emitting body located within said housing, said housing being mounted in said fuel line whereby fuel used for the engine passes through the housing and contacts said body and is thereby exposed to infrared emissions, said body being formed of far infrared emitting particles having an ultrafine particle size, and a radiation capacity in the band of wavelength between 3 and 14 microns, said body consisting of a single unit after being formed with said particles, and wherein the region adjacent to the device is free of any significant magnetic influence and free of any influence of external heat.

2. The device according to claim 1, wherein said far infrared ray emitting body takes a spherical shape.

3. The device according to claim 1, wherein said housing is made of aluminum.

4. The device according to claim 1, wherein said housing has a tubular shape.

5. The device according to claim 1, wherein said ultrafine powder has a particle size of 500 angstrom or below.

* * * * *